United States Patent [19]

Kawai et al.

[11] Patent Number: 5,046,647

[45] Date of Patent: Sep. 10, 1991

[54] NOZZLE FOR DISCHARGING MOLTEN METAL USED IN A CASTING DEVICE

[75] Inventors: Kazuhide Kawai, Nishio; Hiroyuki Mori, Higashi-Sonogi; Satoshi Oya, Anjo; Seiya Sugita, Kariya; Morio Kawasaki; Norifumi Kasai, both of Kashima, all of Japan

[73] Assignees: Toshiba Ceramics Co., Ltd.; Sumitomo Metal Industries, Ltd., both of Japan

[21] Appl. No.: 571,032

[22] Filed: Aug. 22, 1990

Related U.S. Application Data

[63] Continuation of Ser. No. 512,034, Apr. 13, 1990, abandoned, which is a continuation of Ser. No. 238,640, Aug. 30, 1988, abandoned.

[30] Foreign Application Priority Data

Sep. 3, 1987 [JP] Japan ..... 62-220691
Nov. 6, 1987 [JP] Japan ..... 62-279132

[51] Int. Cl.[5] ..... B22D 41/08

[52] U.S. Cl. ..... 222/594; 222/606; 222/591

[58] Field of Search ..... 222/591, 594, 600, 606, 222/607; 266/236

[56] References Cited

U.S. PATENT DOCUMENTS 4,568,007 2/1986 Fishler ..... 222/606
4,691,844 9/1987 Ishino et al. ..... 222/591

FOREIGN PATENT DOCUMENTS 0051172 3/1982 Japan ..... 222/591

*Primary Examiner*—S. Kastler
*Attorney, Agent, or Firm*—David G. Conlin; David S. Resnick

[57] ABSTRACT

A nozzle for discharging molten metal used in a casting device, wherein at least an inner surface portion defining a nozzle bore of the nozzle is made of a refractory, whereby a blockage of the nozzle bore is effectively prevented.

2 Claims, 1 Drawing Sheet

NOZZLE FOR DISCHARGING MOLTEN METAL USED IN A CASTING DEVICE

This is a continuation of copending application(s) Ser. No. 07/512,034 filed on Apr. 13, 1990, now abandoned which is a continuation of copending application(s) Ser. No. 07/238,640 filed on Aug. 30, 1988, now abandoned.

BACKGROUND OF THE INVENTION

The present invention relates to a nozzle for discharging molten metal used in a casting device.

Alumina-graphite and zirconia-graphite have been popularly used as the material of the nozzles for discharging molten metal such as a submerged nozzle for continuous discharging. These materials show high corrosion resistance against molten steel, but they have the defect that they tend to invite deposition of base metal because of their high heat conductivity. Especially in the case of steel with high aluminum content such as aluminum killed steel, there tends to take place blockage of a nozzle bore of the nozzle due to deposition of aluminum oxides such as $Al_2O_3$, necessitating interruption of casting operation.

Countermeasures such as improvement of preheating conditions and heat insulation have been taken, with an appreciable effect, against the blockage due to the deposition of the base metal.

On the other hand, for preventing the blockage due to aluminum oxides, there is employed a slit type submerged nozzle in which a porous refractory is provided on an inner surface portion defining the nozzle bore to introduce an inert gas through the porous refractory. This slit type submerged nozzle, however, has the following problems.

Since it is difficult to provide slits close to a discharging port of molten steel, it is hardly possible to prevent the deposition of metal and the blockage at the area near the discharging port. Also, carbon content of the porous refractory is gradually oxidized away while $SiO_2$ is reacted with the C—CO reducing atmosphere to become SiO and dissipated in that form as the discharging operation is conducted repeatedly. This results in an increased gas permeability of the porous refractory, making it difficult to control the permeation rate of inert gas. Further, increased feed of inert gas encourages formation of pinholes in the cast steel.

Many attempts have been made for preventing the blockage by improving the nozzle material. For instance, Japanese Patent Application Kokai (Laid-Open) No. 57-71860 proposes a method in which a CaO-graphite type refractory is used and the nozzle component is reacted with $Al_2O_3$ in molten steel to produce a CaO-$Al_2O_3$ type low-melting material to thereby use away $Al_2O_3$ which is inclined to deposit on the inner surface.

However, the CaO-$Al_2O_3$ type materials don't always turn out a low-melting material; there could rather be formed a high-melting material, which becomes the core of the deposition of $Al_2O_3$ to expedite the blockage.

SUMMARY OF THE INVENTION

An object of the present invention is to provide a nozzle for discharging molten metal used in a casting device which is capable of effectively preventing the blockage of the nozzle bore.

This object can be achieved by a nozzle for discharging molten metal used in a casting device, wherein at least an inner surface portion defining a nozzle bore of said nozzle is made of a refractory comprising 50 to 94 wt % of $ZrO_2$,
5 to 40 wt % of C,
1 to 10 wt % of $SiO_2$,
not more than 5 wt % of sum of $Al_2O_3$ and $Y_2O_3$, and
not more than 1 wt % of sum of CaO and MgO, said wt % being based on the total weight of said refractory, and a nozzle for discharging molten metal used in a casting device, wherein at least an inner surface portion defining a nozzle bore of said nozzle is made of a refractory comprising CaO and $SiO_2$, the ratio of said CaO to said $SiO_2$ being from 0.18 to 1.86, and $Al_2O_3$ content of said portion being not more than 10 wt % of the total sum weight of said CaO and $SiO_2$.

According to the present invention mentioned above, a nozzle for discharging molten metal can be provided which is capable of effectively preventing the blockage.

Particularly according to the first nozzle of the present invention (set forth as claim 1), the nozzle made of a refractory such as mentioned above, which is mainly composed of $ZrO_2$, is highly proof against wetting by molten steel and is capable of arresting the deposition and growth of oxides. Also, such a nozzle shows high spalling resistance as it contains C. Further, since the content of oxides such as $SiO_2$, $Al_2O_3$, $Y_2O_3$, CaO and MgO is regulated, a glass layer of $SiO_2$ is formed on the inner surface. This glass layer, in a molten state, covers the inner surface and has a viscosity of such a degree as will not suffer melt loss, so that it can maintain smoothness of the inner surface and arrest the separation and deposition of $Al_2O_3$ in steel to prevent the blockage.

The above specification of the contents of the respective components in the present invention is based on the following reasons.

When the content of $ZrO_2$ is less than 50 wt %, there can not be obtained the desired corrosion resistance, and when it exceeds 94 wt %, the amount of C becomes too small to provide the desired spalling resistance.

Either when the content of C is less than 5 wt % or when it exceeds 40 wt %, no desired corrosion resistance is obtained.

When the content of $SiO_2$ is less than 1 wt %, it becomes difficult to form the glass layer on the inner surface, making it unable to obtain the desired effect to prevent the blockage. A greater than 10 wt % $SiO_2$ content results in the reduced corrosion resistance.

It is desirable that other oxides $Al_2O_3$, $Y_2O_3$, CaO and MgO are not contained. For $Al_2O_3$ is the main constituent of the blockage while CaO, MgO and $Y_2O_3$ are reacted with $Al_2O_3$ in steel to form a high-melting compound which serves for promoting the deposition of $Al_2O_3$. In case a CaO—(or MgO—)$Al_2O_3$—$SiO_2$ type glass is produced, there takes place excess lowering of melting point to cause a fusion damage to the nozzle. Therefore, the smaller the contents of said components, the better. However, inclusion of impurities in these components is unavoidable. Therefore, the specified contents of the components in this invention signify the allowable ranges of the contents in which the intended effect to prevent the blockage is not impaired.

And particularly according to the second nozzle of the present invention (set forth as claim 3), the CaO to $SiO_2$ ratio in the inner surface portion is specified to 0.18–1.86, whereby even if $Al_2O_3$ should be deposited on the inner surface, it is reacted with CaO and $SiO_2$ to form a compound having a melting point lower than the molten steel temperature and fused away in molten steel, so that there can be obtained a nozzle which is safe from the blockage in a wide range of working conditions.

When the ratio of CaO to $SiO_2$ is outside said range, the desired low-melting liquid phase is not produced effectively and instead high-melting point calcium aluminate is produced from a solid phase reaction of $Al_2O_3$ and CaO, and such high-melting compound serves as the core of the deposition of $Al_2O_3$. When the content of $Al_2O_3$ exceeds 10 wt % of the total sum weight of CaO and $SiO_2$, the nozzle itself is reduced in melting point because of the reaction of $Al_2O_3$ with CaO and $SiO_2$ and becomes vulnerable to damage by fusion.

$Al_2O_3$ deposited on the inner surface of this invention during the casting operation undergoes a chemical reaction with CaO and $SiO_2$ to form a liquid phase having a melting point below 1,500° C. This liquid phase is flown away with molten steel, so that there takes place no deposition and accumulation of $Al_2O_3$ on the inner surface.

DETAILED DESCRIPTION OF THE PREFERRED EMBODIMENTS

Embodiments of the present invention will be described in detail hereinbelow with reference to the accompanying drawings and tables.

Figure 1:
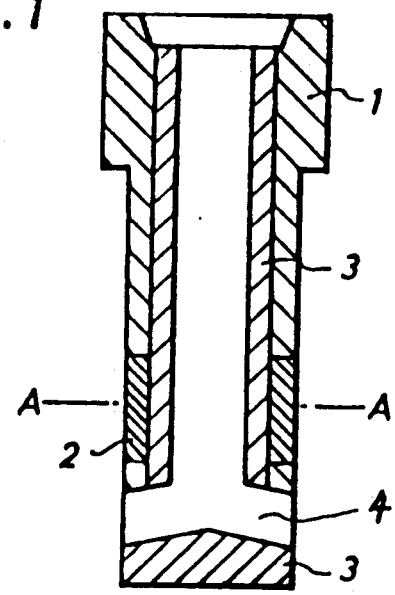
FIG. 1 is a sectional view showing an embodiment of a nozzle according to the first nozzle of the present invention.

FIG. 1 illustrates sectionally a nozzle according to the first nozzle of the present invention. The nozzle consists of a body portion 1 principally composed of $Al_2O_3$ and C, a slag line portion 2 mainly composed of $ZrO_2$ and C, and an inner surface portion 3 defining a nozzle bore 4. The portion 3 is made of a refractory having the composition shown in Table 1. There are produced 13 types of submerged nozzle, and each of them is mounted to a same tundish and subjected to five successive runs of casting of aluminum killed steel. After the casting operation, the narrowing rate of the nozzle bore 4 across the horizontal section at the position indicated by A in FIG. 1 is measured for each of the submerged nozzles, the results being shown in Table 1. The nozzle bore narrowing rate is defined as the ratio of the sectional area of the deposit to the sectional area of the nozzle bore 4.

As seen from Table 1, the narrowing rate in the nozzles of Examples 1 to 7 is less than ⅓ of that in the conventional nozzle of Comparative Example 1 and the nozzles of Comparative Examples 2 to 6 which are outside the defined range of composition of this invention. This attests to the high effect to prevent the blockage of this invention.

In the nozzles of the above-described examples, only the inner surface portion 3 is composed of the specific refractory, but such refractory may be applied to the slag line portion 2 as well. Also, the entirety of the nozzle may be composed of said refractory.

Figure 2:
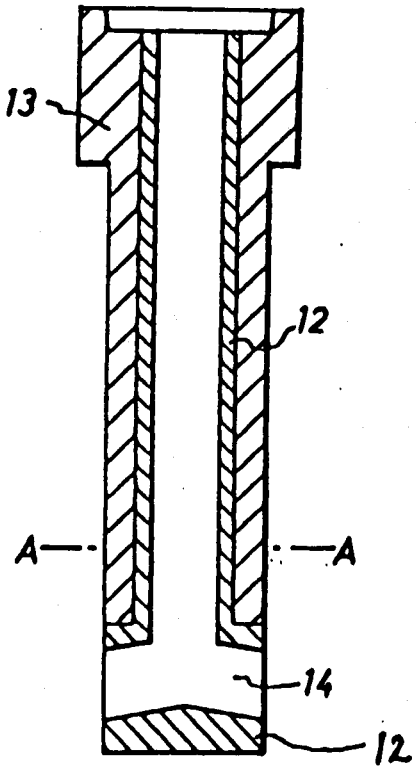
FIG. 2 is a sectional view showing an embodiment of a nozzle according to the second nozzle of the present application.

FIG. 2 is a sectional illustration of a nozzle according to the second nozzle of the present invention. In this nozzle, a body portion 13 is composed of a conventional refractory material (comprised principally of $Al_2O_3$ and C) and an inner surface portion 12 defining a nozzle bore 14 contains CaO and $SiO_2$ in the specified ratio. The composition of the portion 12 and the ratio of CaO to $SiO_2$ in the nozzles of Examples 11 to 19 are shown in Table 2. Those in the nozzles of Comparative Examples 11 to 13 are also shown in Table 2 for comparison.

Each of these nozzles is mounted to a same tundish and subjected to continuous casting of aluminum killed steel under the same conditions. After the casting operation, the narrowing rate of the nozzle bore 14 across the A—A section (FIG. 2) of each of the nozzles is measured and shown in the bottommost rank of Table 2.

As seen from the table, the narrowing rate in the nozzles of Examples 11 to 19 according to this invention is less than ⅓ of that in the nozzles of Comparative Examples 11 to 13, indicating the excellent effect to prevent the blockage according to this invention.

In the nozzles of this invention, $SiO_2$ may be partly replaced with Si. The same effect as described above can be obtained in this case since Si is oxidized into $SiO_2$ on the inner surface.

While the present invention has been described in conjunction with advantageous embodiments, it will be apparent to those skilled in the art that modifications and variations may be resorted to without departing from the spirit and scope of the invention. For example, regarding the composition of the inner surface portion, it is possible to use other materials than those used in Example 11 to 19 provided that the specific condition (the content of $Al_2O_3$ should be less than 10 wt % of the total sum weight of $SiO_2$ and CaO) is met.

TABLE 1

| | | Example 1 | Example 2 | Example 3 | Example 4 | Example 5 | Example 6 | Example 7 | Comp.* Example 1 | Comp. Example 2 | Comp. Example 3 | Comp. Example 4 | Comp. Example 5 | Comp. Example 6 |
|---|---|---|---|---|---|---|---|---|---|---|---|---|---|---|
| Composition (wt %) | $ZrO_2$ | 73 | 69 | 69 | 70 | 60 | 65 | 65 | 0 | 72 | 71 | 71 | 65 | 76 |
| | C | 24 | 24 | 24 | 24 | 27 | 20 | 20 | 30 | 24 | 24 | 24 | 24 | 24 |
| | $SiO_2$ | 1 | 2 | 2 | 5 | 10 | 10 | 10 | 16 | 1 | 1 | 1 | 0.3 | 0 |
| | $Al_2O_3$ | 1 | 4 | 4 | 0 | 1 | 4 | 0 | 52 | 1 | 1 | 1 | 10 | 0 |
| | $Y_2O_3$ | 0 | 0 | 0 | 0 | 2 | 0 | 4 | 0 | 0 | 0 | 0 | 0 | 0 |
| | CaO | 0 | 0.5 | 0 | 0 | 0 | 0.4 | 0.4 | 0 | 1 | 3 | 0 | 0 | 0 |
| | MgO | 0 | 0 | 0.5 | 0 | 0 | 0.3 | 0.3 | 0 | 1 | 0 | 3 | 0 | 0 |
| Nozzlebore narrowing rate (%) | | 8 | 9 | 10 | 5 | 7 | 12 | 12 | 44 | 39 | 52 | 56 | 37 | 42 |

*Comp. Example = Comparative Example

TABLE 2

| | | Example 11 | Example 12 | Example 13 | Example 14 | Example 15 | Example 16 | Example 17 | Example 18 | Example 19 | Comp. Example 11 | Comp. Example 12 | Comp. Example 13 |
|---|---|---|---|---|---|---|---|---|---|---|---|---|---|
| Composition (wt %) | $ZrO_2$ | 68 | 67.5 | 66.5 | 40 | 63.5 | 60 | 55 | 50 | 27 | 40 | 17 | 0 |
| | C | 20 | 20 | 20 | 20 | 20 | 20 | 20 | 20 | 20 | 20 | 20 | 30 |
| | $SiO_2$ | 10 | 10 | 10 | 30 | 10 | 10 | 10 | 10 | 25 | 10 | 10 | 15 |
| | CaO | 2.0 | 2.5 | 3.5 | 10 | 6.5 | 10 | 15 | 18 | 25 | 30 | 53 | 0 |
| | $Al_2O_3$ | 0 | 0 | 0 | 0 | 0 | 0 | 0 | 2 | 3 | 0 | 0 | 55 |
| | CaO/ $Sio_2$ | 0.20 | 0.25 | 0.35 | 0.33 | 0.65 | 1.0 | 1.5 | 1.8 | 1.0 | 3.0 | 5.3 | 0 |
| Nozzlebore narrowing rate (%) | | 15 | 10 | 8 | 6 | 6 | 6 | 12 | 14 | 6 | 57 | 48 | 52 |

What is claimed is:

1. A nozzle for discharging molten metal used in a casting device, wherein an inner surface portion defining a nozzle bore of said nozzle is made of a refractory including at least CaO and $SiO_2$, a ratio of said CaO to said $SiO_2$ being from 0.18 to 1.86, and $Al_2O_3$ content of said inner surface portion being not more than 10 wt % of a total sum weight of said CaO and $SiO_2$, said inner surface portion being adapted so as to be capable of forming a compound having a melting point lower than a melting temperature by reacting CaO and $SiO_2$ with $Al_2O_3$ wherein $Al_2O_3$ is deposited on said inner surface portion.

2. A nozzle according to claim 1, wherein said $SiO_2$ is partially replaced by Si.

* * * * *